US007661621B2

(12) United States Patent
Comotto

(10) Patent No.: US 7,661,621 B2
(45) Date of Patent: Feb. 16, 2010

(54) THREAD TENSIONER

(75) Inventor: Renato Comotto, Biella/Vandorno (IT)

(73) Assignee: IRO AB, Ulricehamn (SE)

( * ) Notice: Subject to any disclaimer, the term of this patent is extended or adjusted under 35 U.S.C. 154(b) by 46 days.

(21) Appl. No.: 11/662,515

(22) PCT Filed: Sep. 7, 2005

(86) PCT No.: PCT/EP2005/009619

§ 371 (c)(1),
(2), (4) Date: Mar. 20, 2008

(87) PCT Pub. No.: WO2006/027233

PCT Pub. Date: Mar. 16, 2006

(65) Prior Publication Data

US 2008/0257994 A1 Oct. 23, 2008

(30) Foreign Application Priority Data

Sep. 10, 2004 (DE) ..... 10 2004 043 867

(51) Int. Cl.
*B65H 59/30* (2006.01)

(52) U.S. Cl. ..... 242/419.3; 242/419.4; 242/150 M

(58) Field of Classification Search ..... 242/419, 242/419.3, 419.4, 147 M, 149, 150 R, 150 M
See application file for complete search history.

(56) References Cited

U.S. PATENT DOCUMENTS 4,641,688 A 2/1987 Gehring et al.
4,875,506 A 10/1989 Gacsay et al.
5,343,899 A 9/1994 Jacobsson et al.
5,363,883 A 11/1994 Weidmann et al.
5,979,810 A 11/1999 Barth
6,161,595 A 12/2000 Shaw et al.
6,188,149 B1 2/2001 DeJager et al.

FOREIGN PATENT DOCUMENTS

BE 1 004 027 A3 9/1992
DE 87 13 749 U1 12/1987
EP 0 622 485 A 11/1994

(Continued)

OTHER PUBLICATIONS

International Search Report dated Nov. 28, 2005 (6 pages).

*Primary Examiner*—John Q Nguyen
*Assistant Examiner*—William E Dondero
(74) *Attorney, Agent, or Firm*—Flynn, Thiel, Boutell & Tanis, P.C.

(57) ABSTRACT

The invention relates to a thread tensioner comprising tensioning elements that define a thread tensioning zone. In said tensioner, the first tensioning element rests on a stop and the second tensioning element can be pressed against the first tensioning element by means of an adjustable magnet contact force produced by a magnet armature and a repelling magnet actuator. The stop is located on the opposite side of the thread tensioning zone from the first tensioning element. The first tensioning element is stressed by a spring force in the direction of the second tensioning element against the stop. Said spring force is greater in the thread tensioning zone than the respectively adjusted maximum magnetic contact force. The mass of the first tensioning element is smaller than the mass of the magnet armature.

14 Claims, 4 Drawing Sheets

FOREIGN PATENT DOCUMENTS

| | | | |
|---|---|---|---|
| EP | 0 961 393 | A | 12/1999 |
| EP | 1 072 707 | A | 1/2001 |
| EP | 1 095 893 | A | 5/2001 |
| FR | 1 200 676 | A | 12/1959 |
| FR | 2 300 734 | A | 9/1976 |
| WO | WO 03/033385 | A1 | 4/2003 |

THREAD TENSIONER

FIELD OF THE INVENTION

The invention relates to a thread tensioner.

BACKGROUND OF THE INVENTION

The yarn tensioner known from U.S. Pat. No. 5,979,810 A (DE 195 31 579 B1) comprises disc-shaped tensioning elements. The first tensioning element is pressed by the second tensioning element by the adjustable magnet pressing force against a stationary stop. The repelling magnet is provided at the rear side of the second tensioning element remote from the first tensioning element and actuates the magnet armature which is arranged in the second tensioning element. The magnet pressing force can be varied steplessly while the thread is running. In case of a slub or a knot occurring in the thread the mass of the second tensioning element must be pressed away together with the mass of the magnet armature and counter to the repelling magnet force of the magnet and away from the first tensioning element which is supported at the stationary stop. Due to the inertia of the large mass, specifically of the magnet armature, a momentary thread tension rise occurs which may lead to a rupture of the thread.

In the thread tensioner known from U.S. Pat. No. 6,161,595 A the first tensioning element is provided at a stationary magnet body. The second tensioning element is movable in relation to the first tensioning element and is actuated by a magnet generating a pulling magnet force through the first tensioning element. In case of a passage of a knot in the thread the second tensioning element is moved counter to the magnet force away from the first tensioning element, whereby the gap width, which is decisive for the strength of the magnet force, is varied, even when the second tensioning element only tilts sidewardly. This momentary increase of the gap width reduces the magnet force significantly such that the tensioning effect is decreased and so that the second tensioning element returns with a critical oscillating phase after the passage of the knot and with a relative delay to the home position. In case of thick thread material the return motion takes place very slowly and in connection with a significant oscillating phase.

In the thread tensioner known from WO 03/033385 A the first tensioning element is provided at a stationary magnet body. The second tensioning element is movably held in a tiltable lid which grips over the magnet body. The second tensioning element is actuated through the first tensioning element by a pulling magnet force and is pressed against the first tensioning element. In case of the passage of a slub or a knot in the thread the second tensioning element is lifted counter to the pulling magnet force such that the strength of the magnet force is reduced and such that the tensioning effect is changed. Specifically in case of a thick thread material the return movement of the second tensioning element after the passage of a knot or a slub may either be delayed or occur with an oscillation phase during which the tensioning effect varies.

It is an object of the invention to provide a thread tensioner of the kind as disclosed above which allows the passage of slubs and knots in the thread without danger to the thread, which then does not vary the tensioning effect significantly, and which instantaneously adjusts the original tensioning effect after the passage of the knot or the slub. The thread tension ought to be useful, in particular, for thick thread qualities.

The function of the thread tensioner according to the invention considers the phenomena that a knot (or a slub) which passes the thread tensioning zone in the running thread with relatively high speed is generating a momentary energy impact lateral to the thread running direction which energy impact has a relatively high frequency. Either the first tensioning element is responding to the occurrence of the energy impact by yielding counter to the spring force, while the second tensioning element and the mass of the magnet armature do not react significantly due to inertia, or the second tensioning element is yielding counter to the spring force, while the magnet armature does not react significantly thanks to the large mass. In each case it is assured that the tensioning effect is not significantly reduced while the knot is passing, because the originally set magnet pressing force or the spring force, respectively, is maintained substantially without any reduction. Furthermore, the deflected tensioning element returns after the passage of the knot instantaneously and without an oscillating phase to the home position, since the tensioning element permanently is under the unchanged force action of the spring force. The thread tensioner having this structure is useful for practically all thread qualities with the same advantages, however, specifically for thick thread material, which generates upon the passage of a knot or a slub a considerable lifting motion. The mass of the respective tensioning element is selected so that the mass can be displaced by the energy impact generated by the knot while the substantially larger mass of the magnet armature will not be displaced by the influence of this energy impact.

The mass of the first tensioning element is displaced counter to the spring force when a knot occurs, while the magnet armature together with the second tensioning element remains substantially motionless. During normal tensioning of the thread without a knot or a slub occurring in the thread the first tensioning element will remain with the spring force at the stationary stop such that the first tensioning element acts like a stationary tensioning surface for the second tensioning element.

The spring assembly provided between the second tensioning element and the magnet armature defines a coupled arrangement for the masses such that the second tensioning element is displaced by a knot counter to the spring force and relative to the magnet armature while the magnet armature remains substantially motionless.

In both cases the originally adjusted tensioning effect is not changed upon passage of a knot. Furthermore, returns the displaced tensioning element immediately into the home position since the displaced tensioning element remains loaded by the in some case even increased spring force or the spring force and the adjusted magnet pressing force.

Expediently, the thread tensioner is a controlled leaf spring tensioner in which the first tensioning element is a leaf spring, while the second tensioning element is a body forming a tensioning surface.

In this case there even may be provided another type of a controlled thread tensioner the first and/or second tensioning element of which is not a leaf spring but e.g. is a rigid body instead.

The leaf spring expediently has the shape of a J with a freely cantilevering end and is anchored with the J-hook to a, preferably, rotatably adjustable support. The spring force is generated by the support, by which force the leaf spring is pressed against the stationary stop such that the leaf spring behaves during normal tensioning operations like a stationary tensioning surface or does not significantly leave the stationary stop even when the magnet pressing force is adjusted to a maximum. By means of a rotatably adjustable support the acting spring force e.g. can be adjusted arbitrarily upon demand.

The second tensioning element expediently is a U-shaped body which either is rigid or resilient, e.g. a leaf spring body which is movably held in a guidance substantially in the direction of the adjustable magnet pressing force. The guidance positions the body in relation to the leaf spring and so that the adjusted magnet pressing force comes into action in the tensioning zone as desired. Furthermore, the guidance allows an easy replacement of the second tensioning element.

In an expedient embodiment the leaf spring (the first tensioning element) is broader at least in the region of the stationary stop than the body (the second tensioning element) which forms the tensioning surface. The leaf spring is supported at the stationary stop by edge regions which protrude sidewardly beyond the body.

The repelling magnet actuator expediently comprises a proportional electromagnet coil which is connected to a current control. In this fashion it is possible to adjust the tensioning force of the magnet armature, e.g. of a permanent magnet, extremely rapidly and delicately, for example, when using the thread tensioner between a thread feeding device and a shuttleless weaving machine in which relatively high thread speeds occur and where a thread tension is desirable which is as uniform as possible and which has to be changed, in some cases several times, within an insertion process. The magnet pressing force directly depends on the strength of the actuating current of the coil.

In a preferred embodiment a stable support of the leaf spring is achieved by ribs for both edge regions of the leaf spring which ribs are provided at both sides of the body.

In a particularly preferred embodiment two thread tensioners are provided on a common carrier and substantially reversed left to right, preferably with an offset in thread running direction. This thread tensioner device is of compact size and can be used for processing two threads which run close to one another. However, each thread tensioner can be controlled individually.

In a structurally simple, reliable and compact embodiment the body forming the tensioning surface is arranged on a disc, preferably with a resilient member between the body and the disc. The disc is coupled via a connection with the magnet armature, preferably with a permanent magnet. In this case the magnet armature is guided together with the disc in an axial guidance so that the magnet armature transmits the magnet pressing force smoothly and so that the disc actuates the second tensioning element in centered fashion.

The axial guidance, in a preferred embodiment, is held in a housing of the magnet actuator.

The ribs defining the stationary stop for the first tensioning element may expediently also be provided at the housing, preferably even in unitary fashion.

The connection having the task of the guidance and the task of the transmission of the force may comprise a guiding body at which the disc is held via a fastening element and an axially and radially compressed O-ring. The guiding body may have a long guiding surface serving as an axial guidance. The compressed O-ring has a centering function and generates a desirable elasticity within the connection.

Since such a thread tensioner expediently operates with a low basic tensioning effect as long as the coil is not supplied with current, it is expedient to place a stationary auxiliary permanent magnet in alignment with and in axial distance from the magnet armature, which auxiliary permanent magnet has a polarisation which is opposite to the polarisation of the magnet armature and which actuates the magnet armature permanently and repellingly. Instead of such a permanent magnet alternatively a weak spring could be provided, the spring force of which may be adjustable.

BRIEF DESCRIPTION OF THE DRAWINGS

Embodiments of the invention will be explained with the help of the drawings, in which.

DETAILED DESCRIPTION

Figure 1:
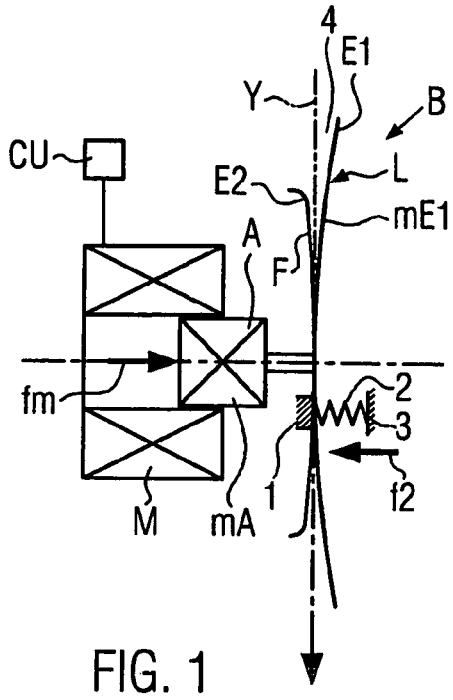
FIG. 1 schematically shows a first embodiment of a thread tensioner, during normal thread run.
Figure 2:
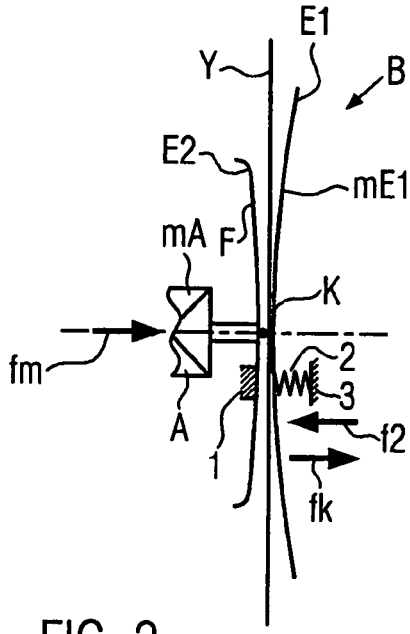
FIG. 2 shows the thread tensioner of FIG. 1 in case of the passage of a knot in the thread.

In FIG. 1 a thread tensioner B is shown schematically in a position during normal thread run and in FIG. 2 in a position in case of a passage of a knot in the thread. The thread tensioner B comprises a first tensioning element E1, e.g. a leaf spring L, which is pressed by a spring 2 or by a respective pre-load with a spring force f2 against a stationary stop 1. The spring 2 is supported e.g. at a stationary support 3. In some cases the spring force f2 may be adjustable. The first tensioning element E1 has a mass mE1.

Furthermore, the thread tensioner B comprises a second tensioning element E2 which is a body F forming a tensioning surface, e.g. a leaf spring body F. The first and second tensioning elements E1, E2 are arranged in relation to one another so that an entrance gap 4 leads to a tensioning zone defined between the tensioning elements E1, E2. The entrance gap 4 converges in thread running direction of a thread Y which is indicated by a dash-dotted line. The second tensioning element E2 is arranged at the side of the stop 1, however the second tensioning element E2 has been inserted, is freely movable in relation to the stationary stop 1. A magnet armature A is connected with the second tensioning element E2. The magnet armature A has a mass mA. The magnet armature A is actuated by an adjustable magnet pressing force fm of a repelling magnet actuator M and is pressed against the first tensioning element E1. The magnet actuator M, expediently, contains a proportional electromagnetic coil connected to a current control CU. The magnet actuator M generates the magnet pressing force fm corresponding to the value of the current as supplied. The magnet armature A e.g. is a permanent magnet, such that in total a repelling linear magnet actuator M is formed.

The spring force f2 for the first tensioning element E1 is, at least in the tensioning zone, larger than the respective adjusted maximum magnet pressing force fm. The mass mE1 of the first tensioning element E1 is, at least in the tensioning zone, smaller than the mass mA of the magnet armature A.

During normal thread run (FIG. 1) the thread Y is tensioned within the tensioning zone corresponding to the magnitude of the adjusted magnet pressing force fm. In this case the first tensioning element E1 remains held at least substantially resting on the stationary stop 1.

When a slub or a knot K (FIG. 2) occurs in the thread Y, then the knot K runs with in some cases relatively high running speed of the thread Y through the thread tensioner B. In this case the knot K generates an energy impact which tends to move both tensioning elements E1, E2 away from one another. Since the mass mA of the magnet armature A has a certain inertia due to which the mass mA cannot be displaced in FIG. 2 to the left side significantly by the energy impact which armature A is acting together with the adjusted magnet pressing force fm via the second tensioning element E2 at the first tensioning element E1 in the thread tensioning zone, the first tensioning element E1 yields due to the in some cases markedly smaller mass mE1 in relation to the mass mA under the influence of the energy impact and counter to the spring force f2, as the energy impact generates a force fK which is directed in FIG. 2 to the right side. During the passage of the knot K, however, the adjusted magnet pressing force Fm and also the spring force f2 are acting such that the tensioning effect is not significantly changed. As soon as the knot K has passed, the low mass mE1 of the first tensioning element E1 is immediately returning by the spring force f2 and without an oscillating phase into the position of FIG. 1.

Figure 3:
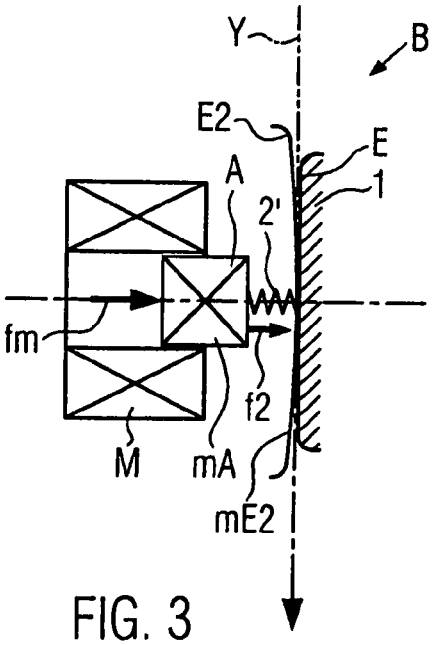
FIG. 3 schematically shows another embodiment of a thread tensioner, during normal thread run.
Figure 4:
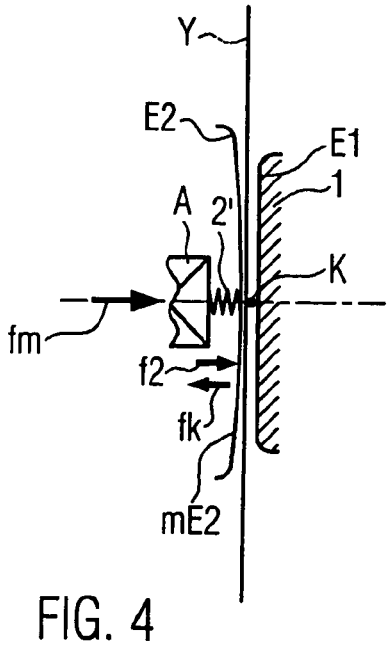
FIG. 4 shows the thread tensioner of FIG. 3 in case of a passage of a knot in the thread.

The embodiment of the thread tensioner shown in FIGS. 3 and 4 differs from the embodiment of FIGS. 1 and 2 in that the spring force f2 e.g. is generated by a spring assembly 2' provided between the magnet armature A and the second tensioning element E2. The second tensioning element E2 has a mass mE2 which is significantly lower than the mass mA of the magnet armature A. The spring force f2 is larger than the respectively adjusted maximum magnet pressing force fm. The second tensioning element E2 either is formed at the stationary stop 1 or is provided there as body F which is situated at the side of the tensioning zone which is remote from the second tensioning element E2. During normal thread run (no knot or no slub, FIG. 3) the tensioning element E2 is pressed by the adjusted magnet pressing force fm against the first tensioning element E1. In this case the spring assembly 2' is not significantly compressed since the spring force f2 is larger than the respective adjusted maximum magnet pressing force fm. A tensioning effect is achieved which depends on the current supplied to the magnet coil.

As soon as a knot K occurs in the thread Y (FIG. 4), the mass mE2 of the second tensioning element E2 becomes displaced to the left side against the spring force f2 by the force fK resulting from the energy impact and relative to the mass mA of the magnet armature which remains substantially motionless due to the inertia, in order to let the knot K pass. In this case the magnet pressing force fm remains unchanged, and is acting, thanks to the compression of the spring assembly 2', even with a slightly increased spring force f2, such that the adjusted tension effect does not change despite the passage of the knot K. As soon as the knot K has passed, the second tensioning element E2 instantaneously is returning into the position according to FIG. 3, in particular by the influences of the forces fm and f2. In this case no oscillating phase will occur since the lower end of the leaf spring body F (second tensioning element E2) already has returned while the knot was on its way out of the thread tensioner.

Figure 5:
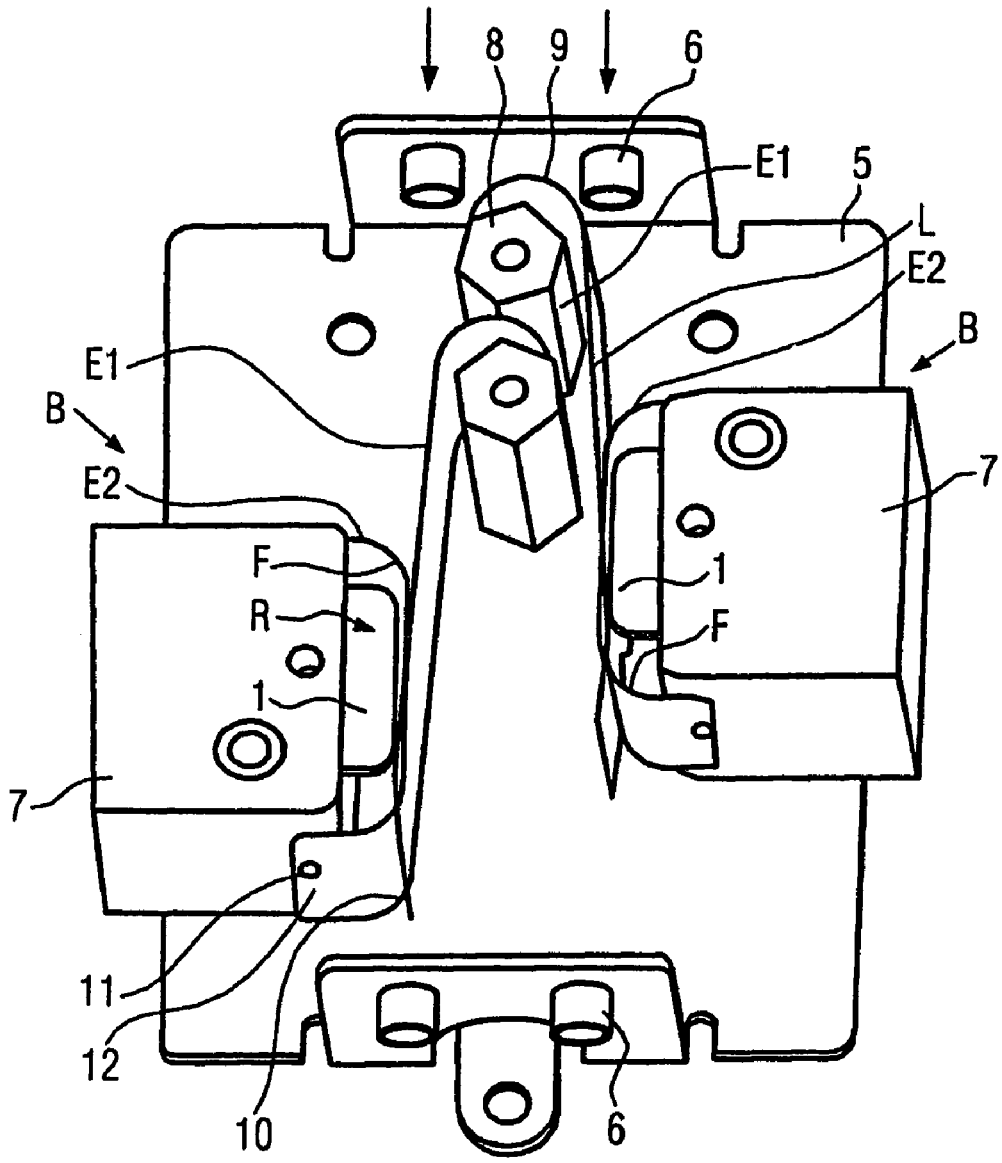
FIG. 5 is a perspective top view of a further embodiment of a thread tensioner device.

FIG. 5 shows a precise embodiment of a thread tensioner device B in which two thread tensioners similar to those shown in FIGS. 1 and 2 are commonly provided on a carrier 5. Thread eyelets 6 are arranged at the carrier 5 which basically determine the thread running paths through both thread tensioners. However, each of those thread tensioners also may be arranged alone on a carrier 5 instead.

Each first tensioning element E1 is a leaf spring L having the shape of a J. The free end 10 of the J is cantilevering freely, while the J-hook is anchored at a support 8 provided on the carrier 5 so that the first tensioning element E1 is pressed by the spring force F2 against the stationary stop 1 in the respective tensioning zone. The spring force f2 e.g. may be adjusted by rotating the support 8.

Each magnet actuator M is contained in a housing 7 at which the stationary stop is formed by two ribs R. In this case, the second tensioning element A is a U-shaped body F, e.g. made from a leaf spring, or in some cases even from rigid material, and is narrower than the leaf spring L, so that the leaf spring L rests with side edge regions on the ribs R.

At the magnet housing 7 a motion guidance 11, 12 is provided for the second tensioning element E2, e.g. in the form of longitudinal slits 12 in the legs of the U, into which slits pins 11 engage. This longitudinal guidance allows the movability of the second tensioning element E2 in case of variations of the magnet pressing force and/or during the tensioning operation.

Figure 6:
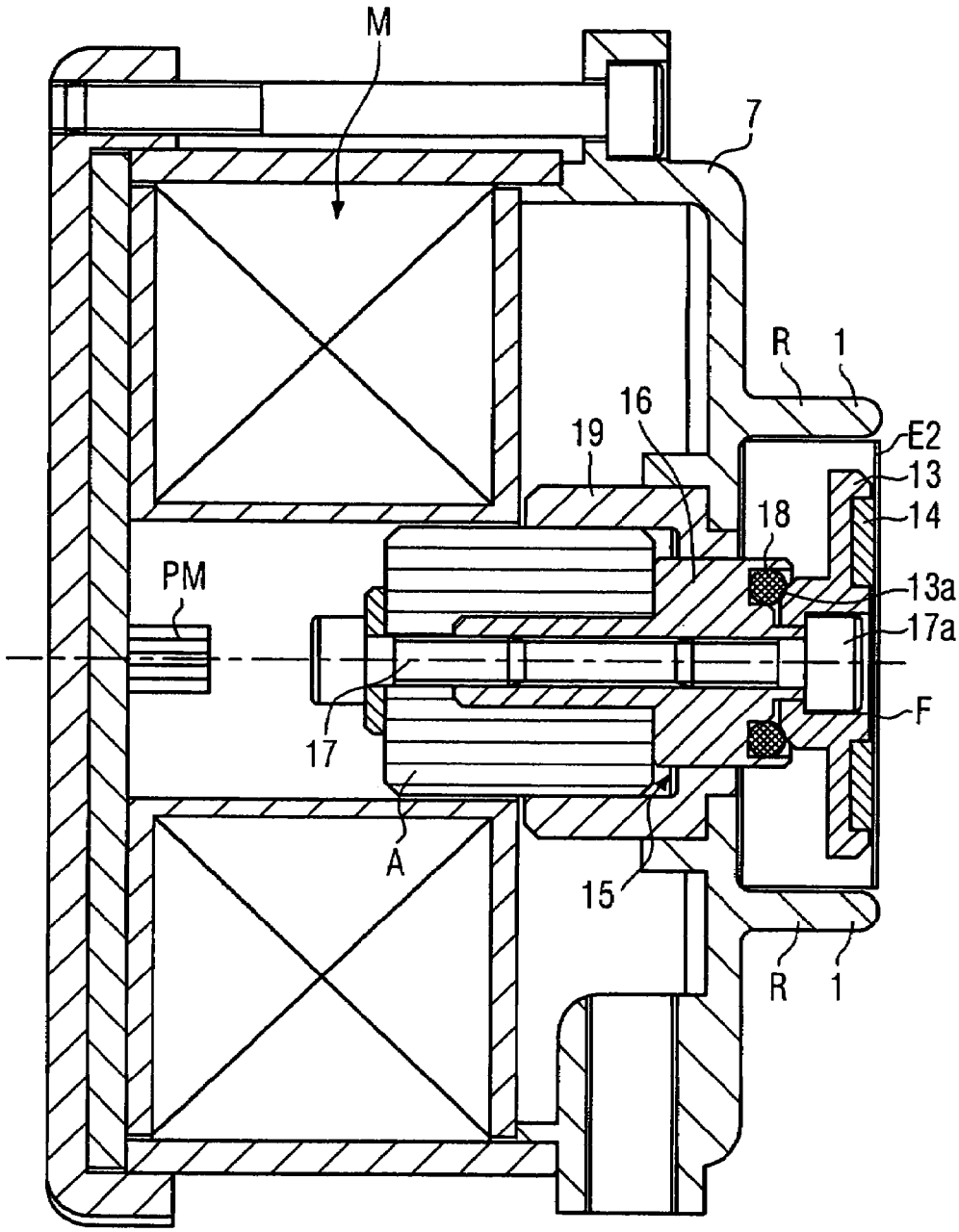
FIG. 6 is an axial section of a main part of the thread tensioner, e.g. of FIGS. 1, 2 and 5.
Figure 7:
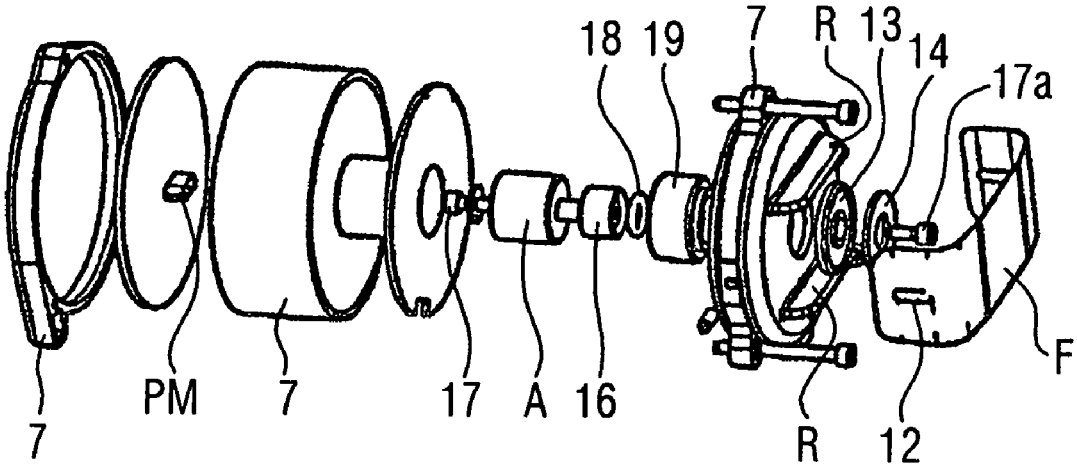
FIG. 7 is an exploded view belonging to FIG. 6.

FIG. 6 is an axial section of main components of the thread tensioner B as shown in FIG. 5 and in FIGS. 1 and 2, while FIG. 7 is an exploded view belonging to this embodiment.

The magnet actuator M is contained together with the coil in the housing 7 and defines an inner channel within which the magnet armature A (a permanent magnet) is lineally movable for the actuation by the repelling magnet force fm in FIG. 6 on the right side. Optionally, furthermore, a stationary auxiliary permanent magnet PM may be placed in the housing 7, which auxiliary permanent magnet PM is axially aligned with and axially distant from the magnet armature A. The auxiliary permanent magnet PM (opposite polarisation) generates a weak magnet pressing force for the second tensioning element E2 in order to generate a basic tensioning effect even when the coil is not supplied with current.

The stationary stop 1 is defined by the ribs R which are unitarily formed at the magnet housing 7. The ribs R enclose the second tensioning element E2, i.e. the leaf spring body F, without contact.

The body F forming the tensioning surface in this case e.g. may be bent from a spring sheet metal and is resting on a disc 13. In some cases a spring elastic member 14 may be situated between the disc 13 and the body F. The member may be positioned in a depression of the disc 13 such that the rear side of the body F in some cases even does not contact the disc 13. The disc 13 is coupled via a connection 15 with the magnet armature A. The connection comprises fastening elements 17, 17*a* and a guiding body 16. An O-ring 18 is arranged between the guiding body 16 and the disc 13. The O-ring 18 is axially and radially compressed by the action of the fastening element 17*a* in order to implement a certain elasticity into the connection 15 and to center the disc 13 properly and somewhat yieldably. The guiding body 16 is axially guided in an axial guidance 19 such that the guiding body 16 is guiding the magnet armature A and the disc 13 as well in axial direction. The axial guidance 19 may be a plastic material sleeve which is secured in the housing 7. The body F e.g. is formed from a thin spring steel strip having a rectangular form and is bent into the shape of a U. The body F has at the tensioning side a rectangular flat tensioning area and in continuation of the tensioning area slightly backward extending surfaces and round end regions which point to the U-legs containing the slits 12 (FIG. 7).

The disc 13 (and/or the guiding body 16) deforms the O-ring 18 by means of a conical or rounded chamfer 13*a* and has an axial distance to the guiding body 16 such that a proper centering effect is achieved for the disc 13 but allowing a certain movability of the disc 13 in relation to the guiding body 16.

Instead of the auxiliary permanent magnet PM a weak spring could be provided in the housing 7 which adjusts the basic tensioning effect of the thread tensioner.

The invention claimed is:

1. Thread tensioner, comprising first and second tensioning elements defining a thread tensioning zone, of which tensioning elements the first tensioning element is co-acting with a stationary stop, while the second tensioning element is pressed against the first tensioning element with an adjustable pressing force by means of a magnet armature connected to the second tensioning element and a repelling magnet actuator, wherein the stationary stop is provided at the side of the thread tensioning zone remote from the first tensioning element, that the first tensioning element is loaded by a spring force in the direction towards the second tensioning element and against the stationary stop, that the spring force is larger in the tensioning zone than the respective adjusted maximum pressing force, and that the mass of the first tensioning element is smaller than the mass of the magnet armature.

2. Thread tensioner according to claim 1, wherein the first tensioning element is a leaf spring.

3. Thread tensioner according to claim 2, wherein the leaf spring has the shape of a J with a freely cantilevering end and a J-hook which is anchored to a, rotatably adjustable support.

4. Thread tensioner according to claim 2, wherein the leaf spring at least in the region of the stationary stop is broader than the second tensioning element.

5. Thread tensioner according to claim 2, wherein the stationary stop comprises ribs for both edge regions of the leaf spring, the ribs being provided at both sides of the body.

6. Thread tensioner according to claim 5, wherein the ribs are, unitarily, provided at the housing.

7. Thread tensioner according to claim 2, wherein the second tensioning element is resting on a disc, with a spring elastic member between the second tensioning element and the disc, the disc is coupled via a connection with the magnet armature which, is a permanent magnet, and the magnet armature and the disc are guided in an axial guidance.

8. Thread tensioner according to claim 7, wherein the axial guidance is secured in a housing of the magnet actuator.

9. Thread tensioner according to claim 8, wherein an auxiliary permanent magnet is arranged in the housing in alignment with and at an axial distance from the magnet armature, and the auxiliary permanent magnet has a polarisation which is opposite to the polarisation of the permanent magnet of the magnet armature.

10. Thread tensioner according to claim 7, wherein the connection comprises a guiding body and the disc is supported, and centered, yieldably, at the guiding body via a fastening element and an axially and radially compressed O-ring.

11. Thread tensioner according to claim 10, wherein an axial clearance is formed between the disc and the guiding body, and the disc and/or the guiding body is provided with a conical or rounded chamfer compressing the O-ring via the fastening element.

12. Thread tensioner according to claim 1, wherein the second tensioning element is a, substantially U-shaped body forming a tensioning surface, and in the form of a U-shaped bent spring steel strip, and the body is movably held in a guidance such that it is movable at least substantially in the direction of the adjustable magnet pressing force.

13. Thread tensioner according to claim 1, wherein the repelling magnet actuator comprises a proportional electromagnet coil connected to a current control.

14. Thread tensioner according to claim 1, wherein two thread tensioners are provided substantially in reverse left to right fashion at a common carrier, with an offset between the thread tensioners in a thread running direction.

* * * * *